US006154896A

United States Patent [19]

Houston et al.

[11] Patent Number: 6,154,896

[45] Date of Patent: Dec. 5, 2000

[54] HEAVY DUTY POWER-ASSISTED TOILET SEAT LIFT ASSEMBLY

[76] Inventors: John Houston, 129 S. Florence, Witchita, Kans. 67209; Richard Freidenberger, 2302 N. Amarado St., Wichita, Kans. 67205-1526

[21] Appl. No.: 09/540,087

[22] Filed: Mar. 31, 2000

[51] Int. Cl.[7] ..... A47K 13/10

[52] U.S. Cl. ..... 4/667; 297/DIG. 10

[58] Field of Search ..... 4/667, 237, 239, 4/246.4, 560.1, 561.1, 562.1; 297/DIG. 10; 254/124; 5/610; 108/1, 4, 6, 7, 9

[56] References Cited

U.S. PATENT DOCUMENTS

| | | | |
|---|---|---|---|
| 3,925,833 | 12/1975 | Hunter . | |
| 4,581,778 | 4/1986 | Pontoppidan . | |
| 4,587,678 | 5/1986 | Love et al. . | |
| 4,993,085 | 2/1991 | Gibbons . | |
| 5,063,617 | 11/1991 | Ward et al. . | |
| 5,142,709 | 9/1992 | Mc Guire | 4/667 |
| 5,155,873 | 10/1992 | Bridges . | |
| 5,265,935 | 11/1993 | Geisler | 297/DIG. 10 |
| 5,309,583 | 5/1994 | White et al. | 4/667 |
| 5,440,767 | 8/1995 | Bergenwall | 4/667 |
| 5,561,872 | 10/1996 | Phillips . | |
| 5,588,162 | 12/1996 | Robinson . | |
| 5,592,703 | 1/1997 | Jones et al. . | |
| 5,626,389 | 5/1997 | Logan, Jr. . | |
| 5,661,858 | 9/1997 | House et al. . | |
| 5,819,325 | 10/1998 | Richards . | |

*Primary Examiner*—Henry J. Recla
*Assistant Examiner*—Tuan Nguyen
*Attorney, Agent, or Firm*—Jeffrey L. Thompson; Thompson & Thompson, P.A.

[57] ABSTRACT

A powered lift assist toilet seat assembly is disclosed for assisting physically impaired persons in being raised from and lowered to a position above a conventional toilet to perform normal toilet functions. The seat assembly includes a movable platform having a central opening, a toilet seat secured over the opening, and a pair of handrails secured to the platform on both sides of the toilet seat. An arrangement of link members are pivotally connected between the movable platform and a lower frame for controlling a movement of the platform upon actuation of a drive member. The arrangement of link members is such that the movable platform is pivoted and moved forwardly when the platform is raised by actuation of the drive member. The arrangement of link members includes first and second link assemblies positioned on respective sides of the platform which are interconnected by a pair of transverse shafts to increase a load capacity and stabilize the platform during operation. A shock absorber mechanism is secured to the movable platform to provide a slow and safe lowering of the toilet seat in the event of a mechanical failure of the drive member.

21 Claims, 9 Drawing Sheets

HEAVY DUTY POWER-ASSISTED TOILET SEAT LIFT ASSEMBLY

BACKGROUND OF THE INVENTION

1. Field of the Invention

The present invention relates generally to devices for assisting physically impaired persons in performing normal toilet functions. In particular, the present invention relates to a heavy duty power-assisted toilet seat lift assembly for assisting a person in being raised from and lowered onto a toilet.

2. Description of the Related Art

Physically impaired persons often have difficulty in performing normal toilet functions, such as being raised from and lowered onto a toilet. Health care providers are often relied upon to help position physically impaired persons on a toilet and to lift the persons from the toilet. Lifting of physically impaired persons by health care providers has often caused strained backs and other injuries to the health care provider, as well as to the person being assisted.

A variety of designs for powered lift toilet seats have been disclosed in the prior art. For example, U.S. Pat. No. 4,587,678, issued to Love et al., discloses a stationary frame with fixed handrails. A seat assembly is pivotally coupled to the stationary frame, and an electric motor and lift arms are provided for pivotally moving the seat frame assembly relative to the stationary frame. While the toilet seat assembly of Love et al. has a pivoting seat assembly, a vertically movable toilet seat has also been disclosed, for example, in U.S. Pat. No. 3,925,833 issued to Hunter. Hunter employs a hydraulic cylinder for raising and lowering the seat.

Another version of an electrically operated toilet seat is disclosed in U.S. Pat. No. 5,155,873 issued to Bridges. Bridges discloses armrests that can be swung out of the way to enable an attendant to assist a disabled person in using the device. Another form of hydraulically powered lift seat is disclosed in U.S. Pat. No. 4,993,085 issued to Gibbons. Gibbons discloses a pair of hydraulically operated lift assemblies with associated armrests that are tilted to cause the armrests to move in an upward and forward position as the mechanism is operated. The seat is provided with a second pair of hydraulically operated lifts to tilt the seat up and forward as the lift assemblies are operated.

Other powered lift toilet seats have been disclosed that include mechanical linkages that allow the seat to tilt while moving upward and forward. For example, U.S. Pat. No. 4,581,778 issued to Pontoppidan discloses a mechanism comprising two supporting arms that are coupled at one of their ends to the seat and cooperate at their other end with a fixed point and a driving member to provide a tilting motion while moving upward and forward. Another such powered lift toilet seat is disclosed in U.S. Pat. No. 5,661,858 issued to House et al., which uses a gear mechanism to lift and move forward the front of the toilet seat and a lever action to cause the rear of the toilet seat to rise and tilt forward with respect to the front of the seat. A linear actuator is provided to effect the gear and rear lever action.

While the conventional powered lift toilet seats described above provide an improvement over manual lifting of physically impaired persons, these devices suffer from several disadvantages. For example, the powered lift toilet seat of House et al. cannot be used with a conventional toilet because the actuator, gear and linkage mechanisms are arranged such that they would interfere with positioning the toilet seat over a conventional toilet. Instead, the toilet seat of House et al. includes its own built-in toilet bowl. The powered lift toilet seats of Love et al., Hunter, Bridges, and Gibbons fail to provide a powered lift toilet seat that tilts while moving upward and forward. Thus, these devices are difficult to use and ineffective for many physically impaired persons, making them unsuitable for many applications. The toilet seat lift of Pontoppidan provides a seat movement during lifting that is physiologically improved over those of Love et al., Hunter, Bridges, and Gibbons. However, the linkage mechanism disclosed by Pontoppidan includes sliding connections that result in a high friction loss and reduced stability during operation.

Thus, there is a need in the health care industry for an improved power assisted toilet seat that provides an optimum movement with increased stability for raising a physically impaired person from a toilet and assisting the person to sit on the toilet.

SUMMARY OF THE INVENTION

It is an object of the present invention to provide an improved power assisted toilet seat assembly that solves the problems with the conventional devices and methods described above.

More specifically, the principal objects of the present invention are to provide a power assisted toilet seat assembly: that facilitates a physically impaired person in being raised from and seated on a toilet; that can be positioned over and used with a conventional toilet; that provides an optimum lifting movement of the toilet seat by tilting the rear of the seat upwardly relative to the front of the seat as the seat moves upward and forward; that includes a weight absorbing device as a safety backup in the event the power actuator fails; that includes handrails that move with the toilet seat to facilitate balancing by the impaired person and safety in operation; that can be adjusted to change the angle of tilt imparted to the seat as it is raised; that can be adjusted to change the height of the seat in its lowered position; and that is secure and stable when positioned over and used with a conventional toilet.

It is a further object to provide a power assisted toilet seat assembly that is durable and safe to use, economical to manufacture, capable of a long operating life, and particularly well suited for use by physically impaired persons.

In order to realize the objects and advantages set forth above, that Applicants have developed an improved power-assisted toilet seat assembly for assisting physically impaired persons in being raised from and lowered to a position above a conventional toilet to perform normal toilet functions. The seat assembly includes a movable platform having a central opening, a toilet seat secured over the opening, and a pair of handrails secured to the platform on both sides of the toilet seat. An arrangement of link members is pivotally connected between the movable platform and a lower frame for controlling a movement of the platform upon actuation of a drive member. The arrangement of link members is such that the movable platform has a simultaneous upward lift, forward motion and tilting up of the rear of the seat with respect to the front when the platform is raised by actuation of the drive member. The arrangement of link members includes first and second link assemblies positioned on respective sides of the platform that are interconnected by a pair of transverse shafts to increase a load capacity and stabilize the platform during operation. A shock absorber mechanism is secured to the movable platform to provide a slow and safe lowering of the toilet seat in the event of a mechanical failure of the drive member.

According to a broad aspect of the present invention, an improved power-assisted toilet seat lift assembly is provided, comprising: a support assembly having a movable platform adapted to support a toilet seat over a conventional toilet; a drive member connected to the support assembly for moving the platform; and a linkage means pivotally connected to a plurality of pivot points on respective sides of a central opening of the platform for stabilizing and controlling a movement of the platform upon actuation of the drive member, the linkage means having an arrangement of link members that cause the movable platform to pivot and move forwardly when the platform is raised by actuation of the drive member.

The support assembly preferably comprises a lower frame having first and second sides adapted to be placed on respective sides of a conventional toilet and a front portion connecting the first and second sides. The support assembly further comprises an upper frame having first and second sides that correspond with the first and second sides of the lower frame. The linkage means comprises a first linkage assembly connected between the respective first sides of the upper and lower frame, and a second linkage assembly connected between the respective second sides of the upper and lower frame. The second linkage assembly is connected to the first linkage assembly by at least one torsion shaft for transferring loads between the first and second linkage assemblies to increase a load capacity and stability of the seat lift assembly.

The platform preferably has a central opening and first and second handles secured on respective sides of the central opening. The central opening is adapted to be aligned with an opening in a conventional toilet when the seat lift assembly is positioned over the toilet.

According to another broad aspect of the present invention, a power-assisted toilet seat lift assembly is provided, comprising: a toilet seat; a support assembly adapted to support the toilet seat over a conventional toilet in a position suitable for use by a user, the support assembly having a lower frame and an upper frame connected together by a lift mechanism; the lower frame having a first portion adapted to rest on a floor adjacent to the toilet and a second portion that extends upwardly from a front end of the first portion; the upper frame having a top side on which the toilet seat is secured, and a bottom side on which the lift mechanism is secured; and the lift mechanism comprising a driving member and a first linkage assembly connected between the lower frame and the upper frame. The first linkage assembly comprises: a first link pivotally connected between an upper end of the second portion of the lower frame and a front end of the upper frame; a second link having a first end pivotally connected to a lower front end of the lower frame; a third link having a first end pivotally connected to the upper frame at a location spaced rearward from the front end of the upper frame, the second and third links each having second ends that are pivotally connected together; and a fourth link having a first end pivotally connected to the second link at a location spaced from the second end of the second link. The fourth link has a second end pivotally connected to the upper frame at a location spaced from the first end of the third link. The driving member is operable in conjunction with the first linkage assembly to move the upper frame relative to the lower frame, whereby the toilet seat can be moved from a lowered position to a raised position in which the toilet seat is lifted upwardly, displaced forwardly, and tilted with a rear end of the toilet seat higher than a front end of the toilet seat to accommodate a physically impaired person.

The lower frame of the support assembly comprises first and second sides adapted to be placed on respective sides of a conventional toilet and a front portion connecting the first and second sides. The upper frame of the support assembly comprises first and second sides that correspond with the first and second sides of the lower frame. The lift mechanism further comprises a second linkage assembly having first, second, third and fourth links that are connected in substantially the same configuration as the respective links of the first linkage assembly. The first linkage assembly is connected between the respective first sides of the upper and lower frame, and the second linkage assembly is connected between the respective second sides of the upper and lower frame.

Numerous other objects and advantages of the present invention will be apparent to those skilled in this art from the following description wherein there is shown and described a preferred embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENTS

A power-assisted toilet seat lift assembly 10 according to preferred embodiments of the present invention will now be described in detail by reference to FIGS. 1 to 9 of the accompanying drawings.

Figure 1:
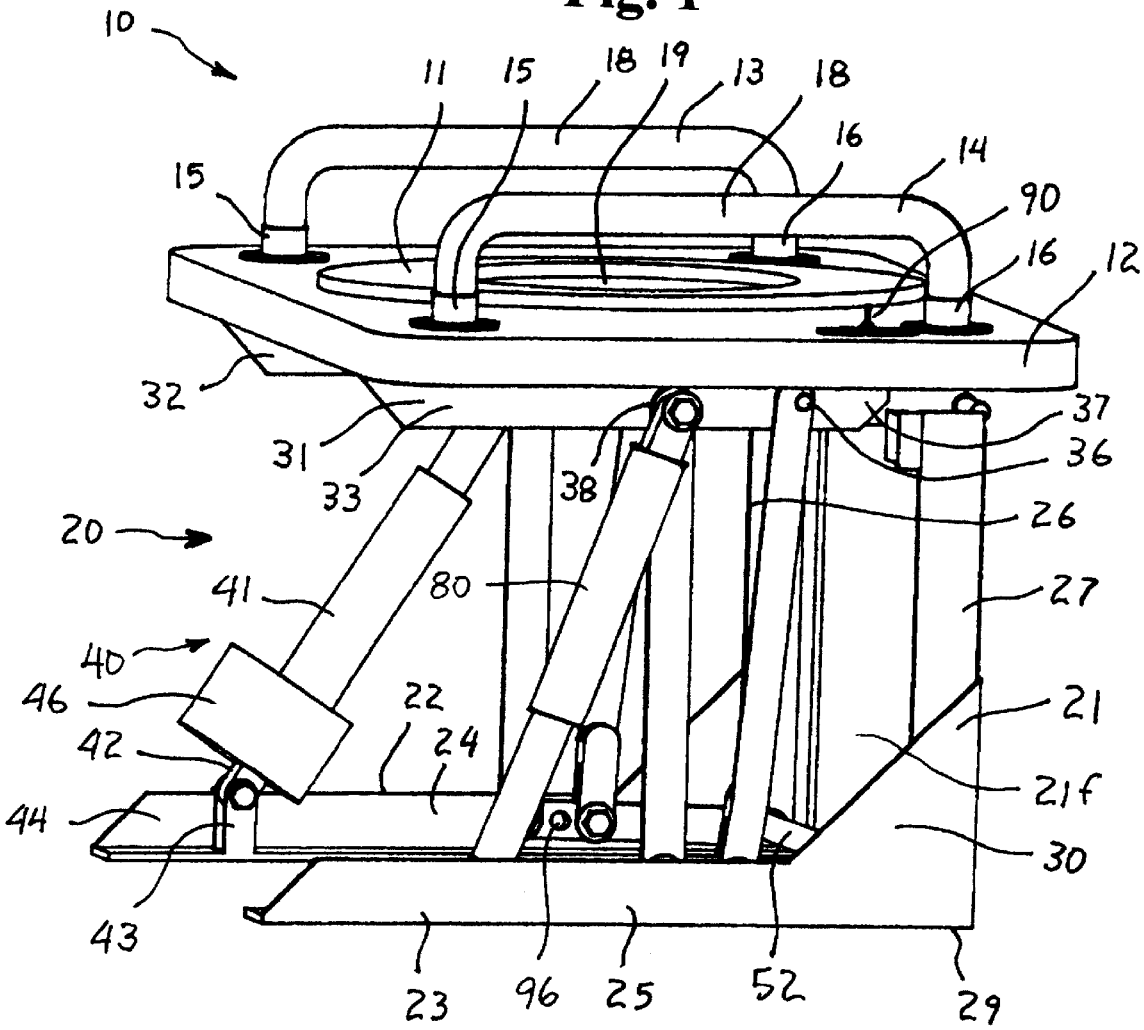
FIG. 1 is a perspective side view of a power-assisted toilet seat lift assembly in a lowered position according to the present invention.

As shown in FIG. 1, a power-assisted toilet seat lift assembly 10 according to the present invention has a toilet seat 11 secured to a generally horizontal platform 12 at a height suitable for use by a physically impaired person. A pair of left and right handles 13, 14 are positioned on each side of the toilet seat 11. The handles 13, 14 each have respective ends 15, 16 that are secured to the platform 12 using threaded screws 17 or other conventional fastening structures. The handles 13, 14 also have horizontal portions 18 extending between the respective ends 15, 16 that are suitable for gripping by a physically impaired person to support the person while using the toilet seat lift assembly 10.

A central opening 19 is provided in the platform 12 beneath the toilet seat 11 and is adapted to be aligned with an opening of a conventional toilet bowl when the seat lift assembly 10 is positioned over the conventional toilet. By positioning the seat lift assembly 10 over a conventional toilet, the flush mechanism of the conventional toilet can be conveniently used for waste disposal. Alternatively, an optional portable pan (not shown) can be secured to the platform using suitable brackets (not shown) provided below the central opening 19 to make the lift assembly 10 a self-contained portable toilet assembly.

A support assembly 20 is provided for supporting the platform 12 and toilet seat 11 over a conventional toilet. The support assembly 20 has a lower frame 21 having first and second sides 22, 23 adapted to be placed on respective sides of a conventional toilet and a front portion 21*f* connecting the first and second sides 22, 23. The first and second sides 22, 23 of the lower frame 21 have first portions 24, 25 adapted to rest on a floor adjacent to the toilet and second portions 26, 27 that extend upwardly from the front ends 28, 29 of the first portions 24, 25. The first and second portions of the lower frame 21 are preferably made from angle-shaped members connected at a lower front end of the lower frame 21 in an L-shaped configuration. A triangular brace 30 is secured to the angle-shaped members to further strengthen the lower frame 21. The front portion 21*f* of the lower frame 21 is preferably made from a metal plate or the like secured to the upwardly extending second portions 26, 27 of the lower frame 21. The connections between the first and second portions 24–27, the triangular braces 30, and the front portion 21*f* are preferably made by welding. However, those skilled in the art will recognize that other suitable connecting means, such as threaded machine bolts, screws, and the like, can be used instead of welding.

The support assembly 20 has an upper frame 31 having first and second sides 32, 33 that correspond with the first and second sides 22, 23 of the lower frame 21. The upper frame 31 is secured to a lower side of the platform 12 and moves with the platform 12. The first and second sides 32, 33 of the upper frame 31 are preferably made from respective angle-shaped members each having a first flat side 34 secured to the lower side of the platform 12, and a second flat side 35 extending downwardly from the platform 12. The second flat sides 35 of the angle-shaped members each have a first bore 36 near a front end 37 thereof, and a second bore 38 spaced rearward of the first bore 36.

The upper frame 31 and lower frame 21 are connected together by a lift mechanism 40. The lift mechanism 40 includes a driving member 41 having a first end 42 connected to a bracket 43 fixed to a rear end 44 of the lower frame 21, and a second end 45 connected to the second bore 38 in the first side 32 of the upper frame 31. The driving member 41 is operable to extend and retract in length to move the upper frame 31 relative to the lower frame 21. The driving member 41 can be, for example, a linear actuator having two threaded components that are rotated relative to each other by an electric motor 46 to cause the driving member 41 to change in length. A suitable actuator of this type is sold by W.W. Grainger, Inc. as the Dayton® AC Linear Actuator Model No. 2H497.

The lift mechanism 40 also includes first and second linkage assemblies 47, 48 connected between the respective sides of the upper frame 31 and the lower frame 21. The first and second linkage assemblies 47, 48 each have an arrangement of link members that cause the respective sides 49, 50 of the platform 12 to pivot together and move forwardly when the platform 12 is raised upwardly by actuation of the driving member 41. The linkage assemblies 47, 48 are connected together by first and second transverse torsion shafts 51, 52 that transfer loads between the first and second linkage assemblies 47, 48 to increase a load capacity and stability of the toilet seat lift assembly 10.

The arrangement of link members in each of the first and second linkage assemblies 47, 48 is substantially the same and includes respective first links 53, 54, second links 55, 56, third links 57, 58, and fourth links 59, 60. The first link 53, 54 of each linkage assembly 47, 48 is pivotally connected between an upper end of the second portion 26, 27 on each respective side 22, 23 of the lower frame 21 and the first bore 36 located at the front end 37 of each respective side 32, 33 of the upper frame 31. The second link 57, 58 of each linkage assembly 47, 48 has a first end 62 pivotally connected to the lower front ends 28, 29 of the lower frame 21, preferably at the approximate location where the first and second portions 24–27 of the lower frame 21 are connected. The third link 57, 58 has a first end 63 pivotally connected to the second bore 38 of the upper frame 31, which is at a location spaced rearwardly of the front end 37 of the upper frame 31. The second links 55, 56 and third links 57, 58 each have second ends 64, 65 that are pivotally connected together. The fourth link 59, 60 of each linkage assembly 47, 48 has a first end 66 pivotally connected to the second link 55, 56 at a location 67 spaced from the second end 64 of the second link 55, 56, and preferably at a location 67 between the first and second ends 62, 64 of the second link 55, 56. The fourth link 59, 60 has a second end 68 pivotally connected to the upper frame 31 at a location 69 spaced forwardly of the first end 63 of the third link 57, 58, and preferably at the same location 69 where the first link 53, 54 is connected to the upper frame 31, i.e., at the first bore 36 of the upper frame 31.

The first and second transverse torsion shafts 51, 52 connect the first and second linkage assemblies 47, 48 by extending between the respective first and second links 53–56 of the linkage assemblies 47, 48. The first transverse torsion shaft 51 is rotatably connected at its ends 71, 72 to the respective upper ends 73, 74 of the upstanding second portions 26, 27 of the lower frame 21. The first links 53, 54 of the linkage assemblies 47, 48 have first ends 75 fixed to the first shaft 51 and are rotatable together with the first shaft 51 about an axis defined by the rotatably connected ends 71, 72 of the first shaft 51. The second transverse torsion shaft 52 is rotatably connected at its ends 76, 77 to the lower frame 21 near the apex where the first and second portions 24–27 of each side 22, 23 of the lower frame 21 are connected. The first ends 62 of the second links 55, 56 of the linkage assemblies 47, 48 are fixed to the second shaft 52 and are rotatable together with the second shaft 52 about an axis defined by the rotatably connected ends 76, 77 of the second shaft 52.

A shock absorber mechanism 80 is provided as a safety mechanism to ensure a slow and smooth descent of the toilet seat 11 in the event of a mechanical failure of the driving member 41, the linkage assemblies 47, 48, or their respective connections. The shock absorber mechanism 80 has a first end 81 connected to a shaft 82 protruding from the lower frame 21, and a second end 83 connected to the upper frame 31. The shock absorber mechanism 80 is preferably connected to the upper frame 31 at the same connection point where the third link 58 of the second linkage assembly 48 is connected to the second side 33 of the upper frame 31, i.e., at the second bore 38 on the second side 33 of the upper frame 31. Similarly, the driving member 41 is preferably connected at the same location where the third link 57 of the first linkage assembly 47 is connected to the upper frame 31, i.e., at the second bore 38 on the first side 32 of the upper frame 31.

The pivotal connections between the link members 53–60, the frames 21, 31, the driving member 41, and the shock absorber mechanism 80 are preferably provided by threaded fasteners, such as machine bolts, that are received through respective bores of the components. Threaded lock nuts or the like are provided to secure the fasteners to the various components while maintaining rotatability between the components.

The lower first ends 66 of the fourth links 59, 60 are preferably each provided with a forked coupler 85, 86 that straddles both sides of the respective second links 55, 56. The connection points of the fourth links 59, 60 to the second links 55, 56 are changeable to different locations on the second links 55, 56 using the forked couplers 85, 86 to adjust an amount of upward tilt of the rear of the toilet seat 11 upon movement of the upper frame 31 to a raised position. For example, by moving the connection point between the fourth link 59, 60 and the second link 55, 56 to a position closer to the second end 64 of the second link 55, 56, a smaller amount of upward tilt of the rear of the toilet seat 11 will be provided as the platform 12 and toilet seat 11 are raised. This adjustment will allow the toilet seat lift assembly 10 to better accommodate persons of different sizes and physical disabilities.

An electric toggle switch 90 is provided on the platform 12 at a convenient position for use by the physically impaired operator. The switch 90 is shown in the drawings under the handle 14 on one side of the platform 12. However, the switch 90 can be located at other positions on the toilet seat lift assembly 10 to accommodate various physical impairments. For example, if a user lacks sufficient strength or movement in his or her fingers to operate the switch 90 conveniently, a switch can be positioned and/or shaped for engagement by the user's arms or feet.

The toggle switch 90 is preferably a momentary control switch that returns to a neutral "OFF" position when released. The switch has "UP" and "DOWN" positions located on either side of the OFF position. When the switch is moved to the UP position, the electric motor 46 of the driving member 41 is energized to extend the length of the driving member 41 to raise the platform 12. When the switch 90 is moved to the DOWN position, the electric motor 46 of the driving member 41 is energized to retract the length of the driving member 41 to lower the platform 12.

Figure 9:
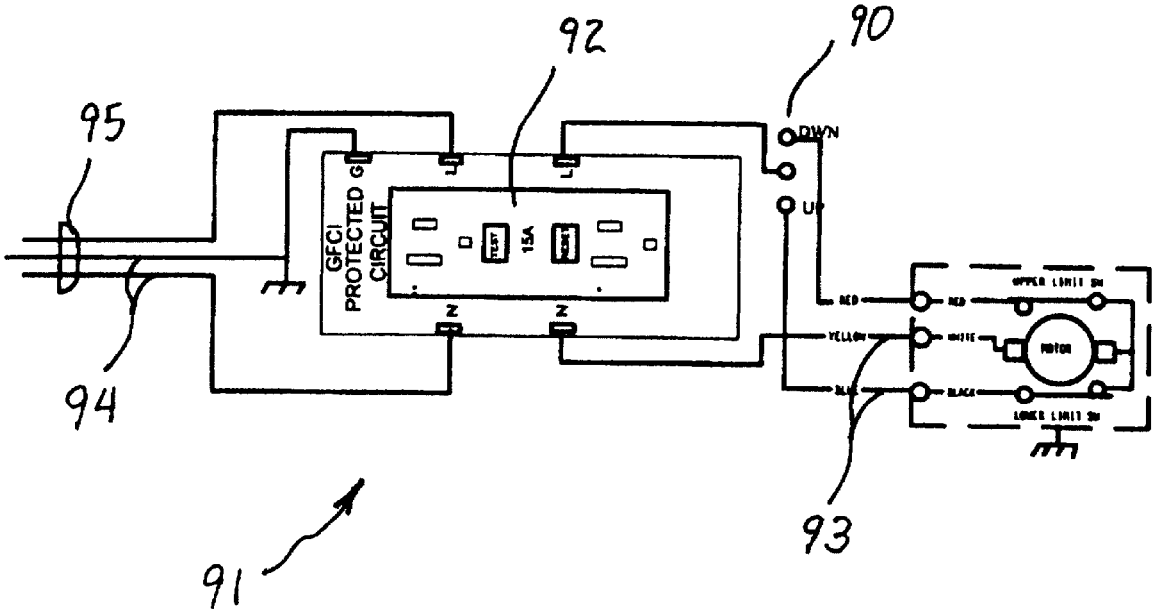
FIG. 9 is an electrical schematic diagram of the electrical circuit of the power-assisted toilet seat lift assembly according to the present invention.

A schematic diagram of the electric circuit 91 of the toilet seat lift assembly 10 is shown in FIG. 9. The electric circuit includes a ground fault circuit interrupter (GFCI) 92 to ensure safety during use. The switch 90 is shown in this circuit 91 schematically with its UP, DOWN and OFF positions. The electric motor 46 is shown as a reversible motor connected to the switch 90 by suitable conductor wires 93 in a known manner. The circuit 91 is connected to a suitable power supply, such as a conventional wall outlet, by electrical power cables 94 and connector plug 95 connected to the GFCI 92. Alternatively, a direct current motor and battery could be used with the toilet seat lift assembly 10 where electrical power is otherwise unavailable or inconvenient.

The toilet seat lift assembly 10 of the present invention can be positioned as shown in FIG. 1 during normal use of the toilet. Since the lift assembly 10 is positioned over a conventional toilet, it is suitable for use by all persons of a household, including those with physical impairments and those without. If the lift assembly 10 is not needed by a particular person using the toilet, it does not interfere with normal toilet functions and can be left in a stationary position over the conventional toilet. If operation of the lift assembly 10 is desired, the person using the toilet can operate the toggle switch 90 to selectively raise and lower the platform 12 and toilet seat 11 to the desired positions.

Figure 2:
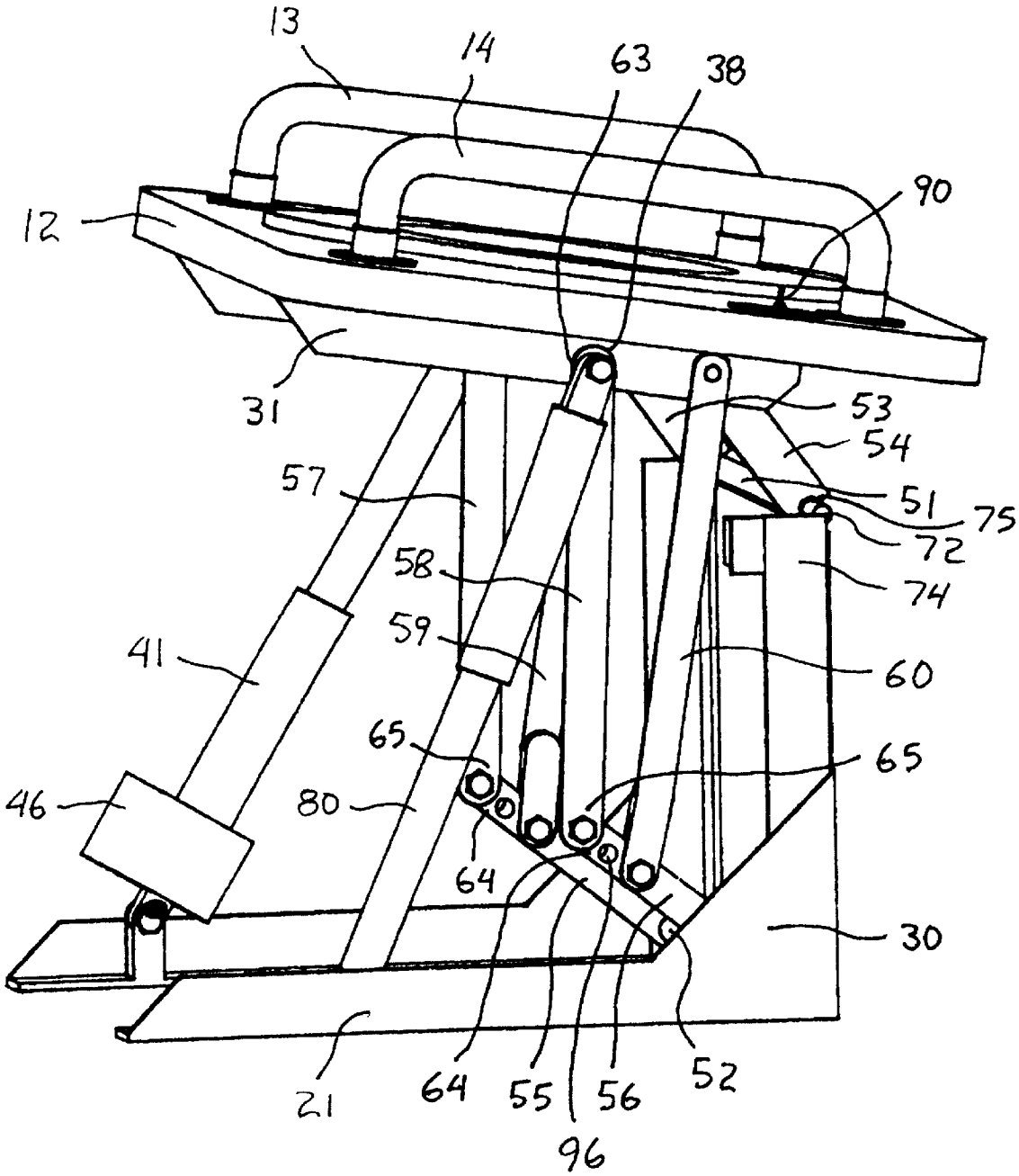
FIG. 2 is a perspective side view of the power-assisted toilet seat lift assembly in a partially raised position according to the present invention.
Figure 3:
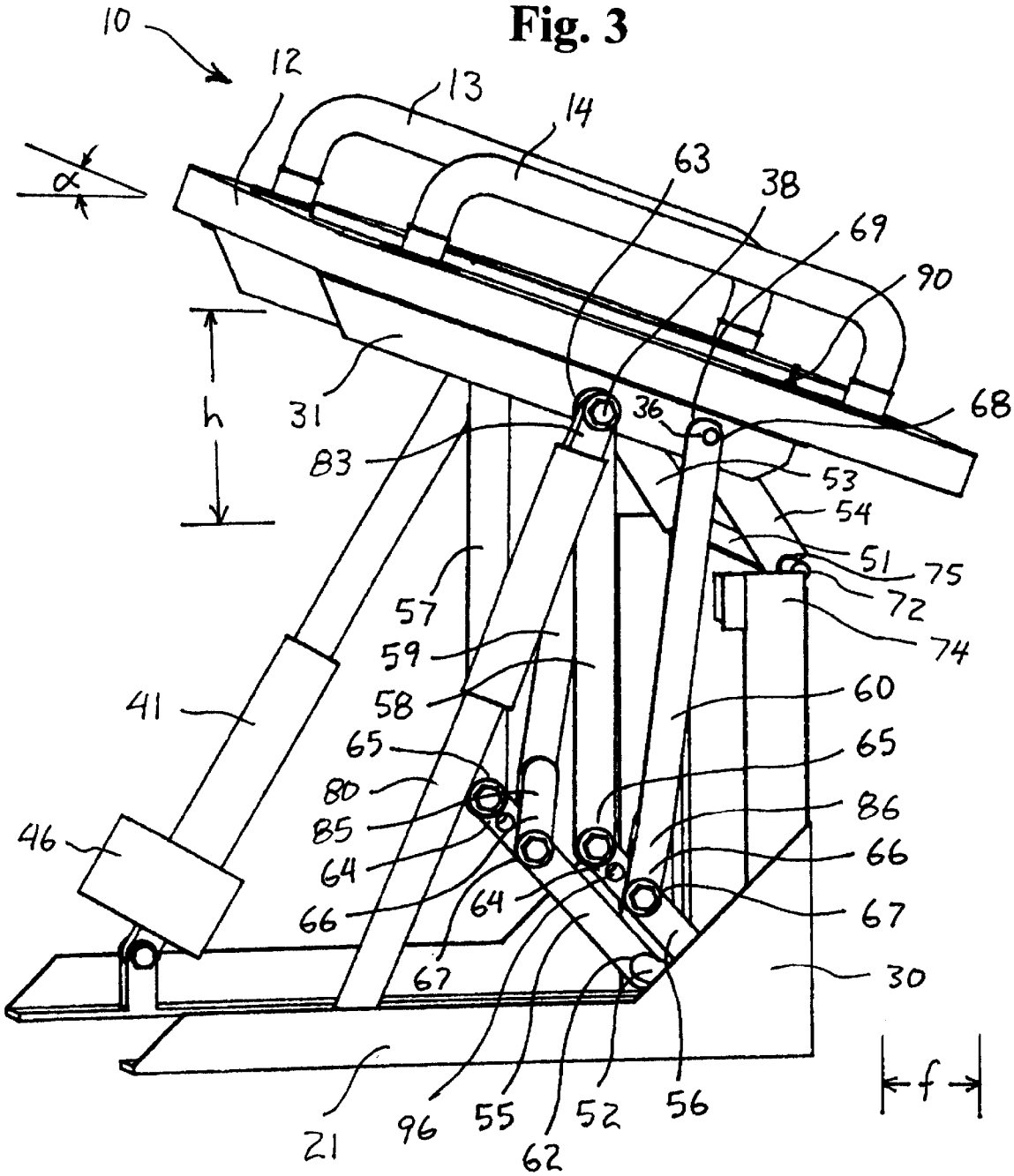
FIG. 3 is a perspective side view of the power-assisted toilet seat lift assembly in a fully raised position according to the present invention.

FIG. 2 shows the toilet seat lift assembly 10 in a partially raised position. As seen in FIG. 2, as the platform 12 is raised, the linkage assemblies 47, 48 provide three separate motions simultaneously, i.e., upward lift, forward motion and tilting up of the rear of the toilet seat 11 with respect to the front. The combination of these motions are important because they allow a physically impaired person to be moved from the toilet seat 11 to an upright position with minimal stress on the person's knees, hips, and so forth. FIG. 3 is a view similar to FIG. 2, with the toilet seat lift assembly 10 in a fully raised position. In this position, the rotation angle a of the platform 12 is approximately 30 degrees relative to horizontal, the total lift h at the center of the toilet seat 11 is approximately seven inches, and the total forward motion f of the toilet seat 11 is approximately four inches. As explained above, the rotation angle a of the platform 12 can be reduced in the fully raised position by moving the connection location of the fourth link 59, 60 rearwardly on the second link 55, 56, i.e., to the open bore 96 shown in FIGS. 1 to 3.

Figure 4:
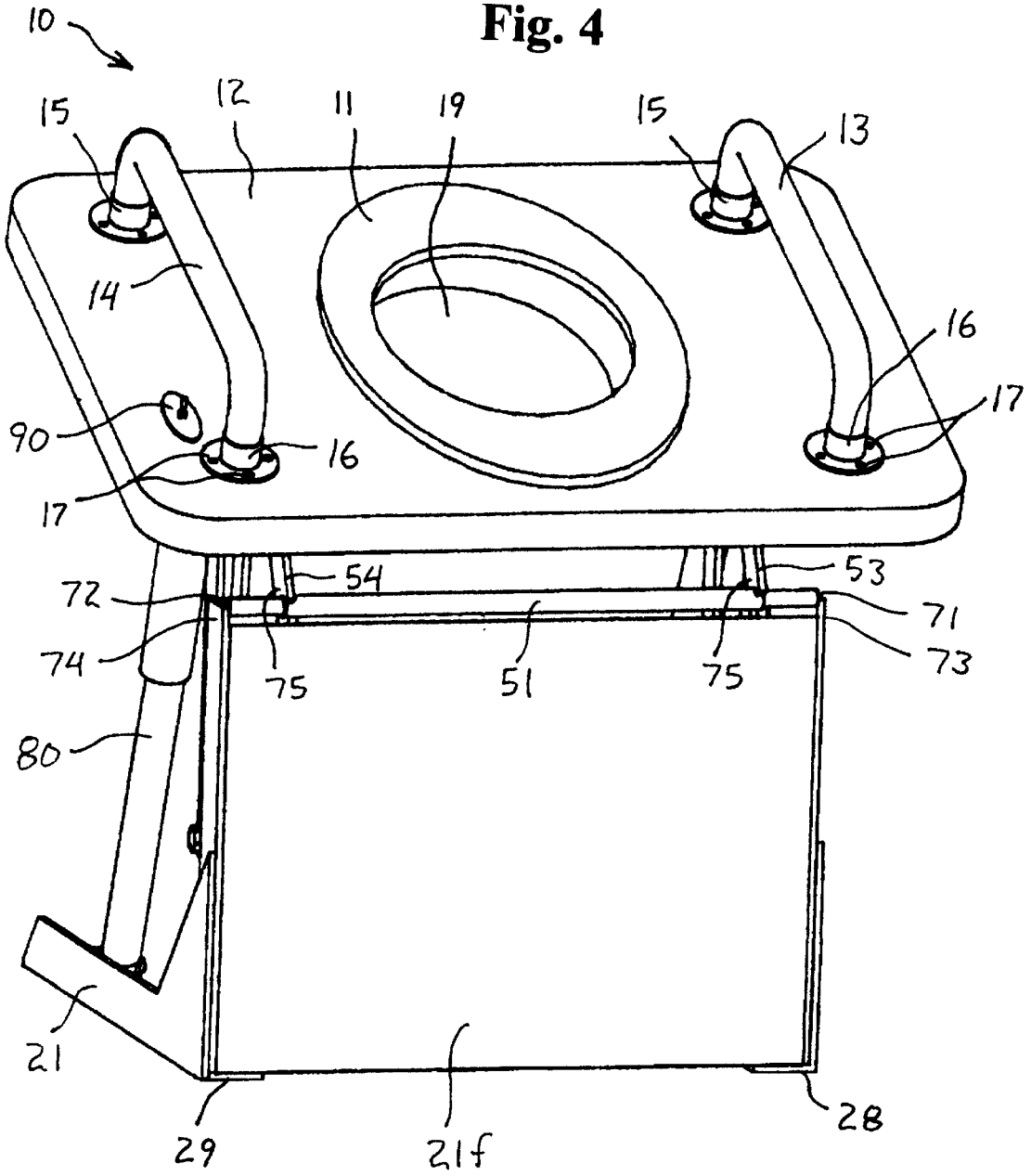
FIG. 4 is a perspective front view of the power-assisted toilet seat lift assembly in a raised position according to the present invention.
Figure 5:
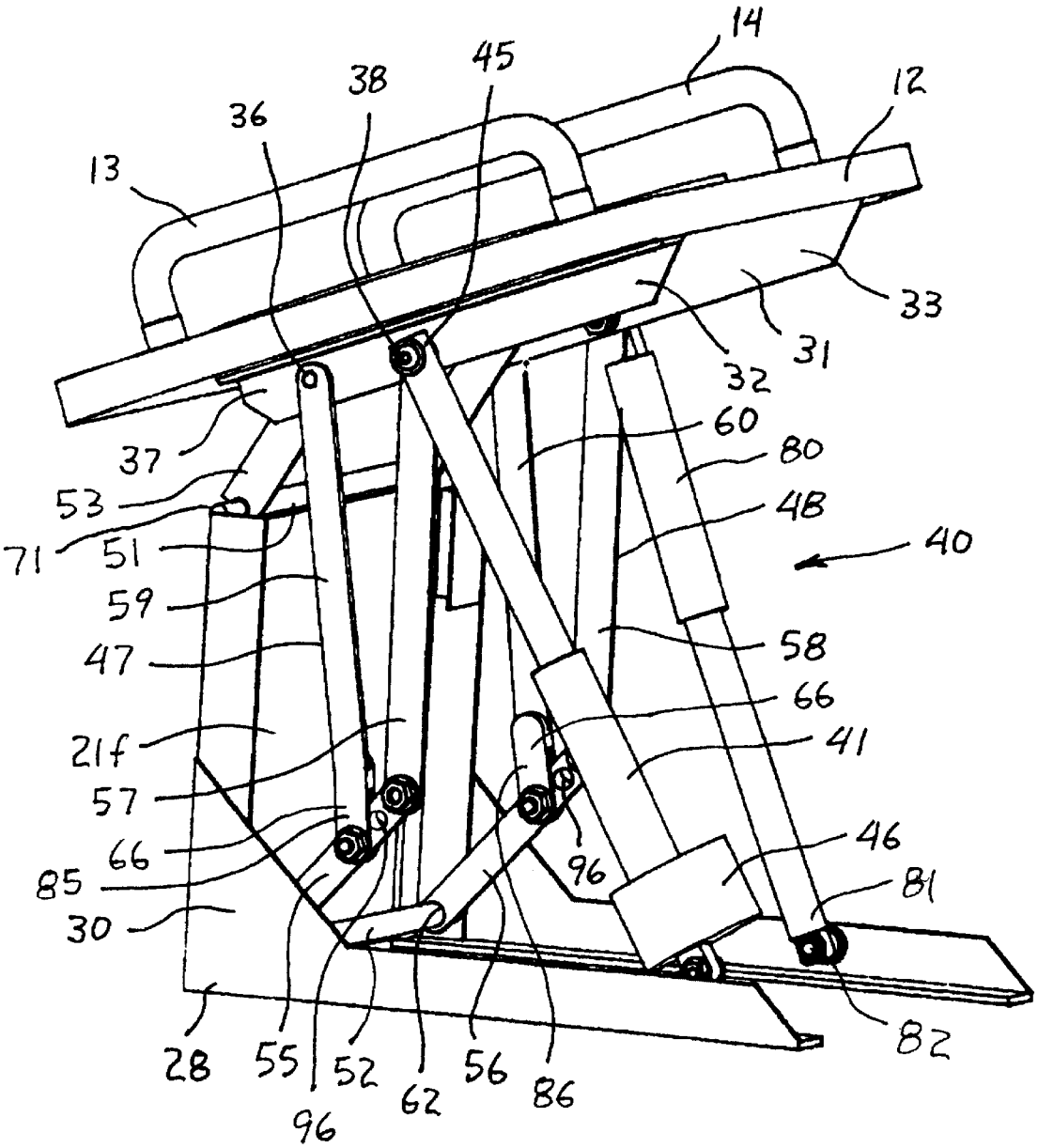
FIG. 5 is another perspective side view of the power-assisted toilet seat lift assembly in a raised position according to the present invention.
Figure 6:
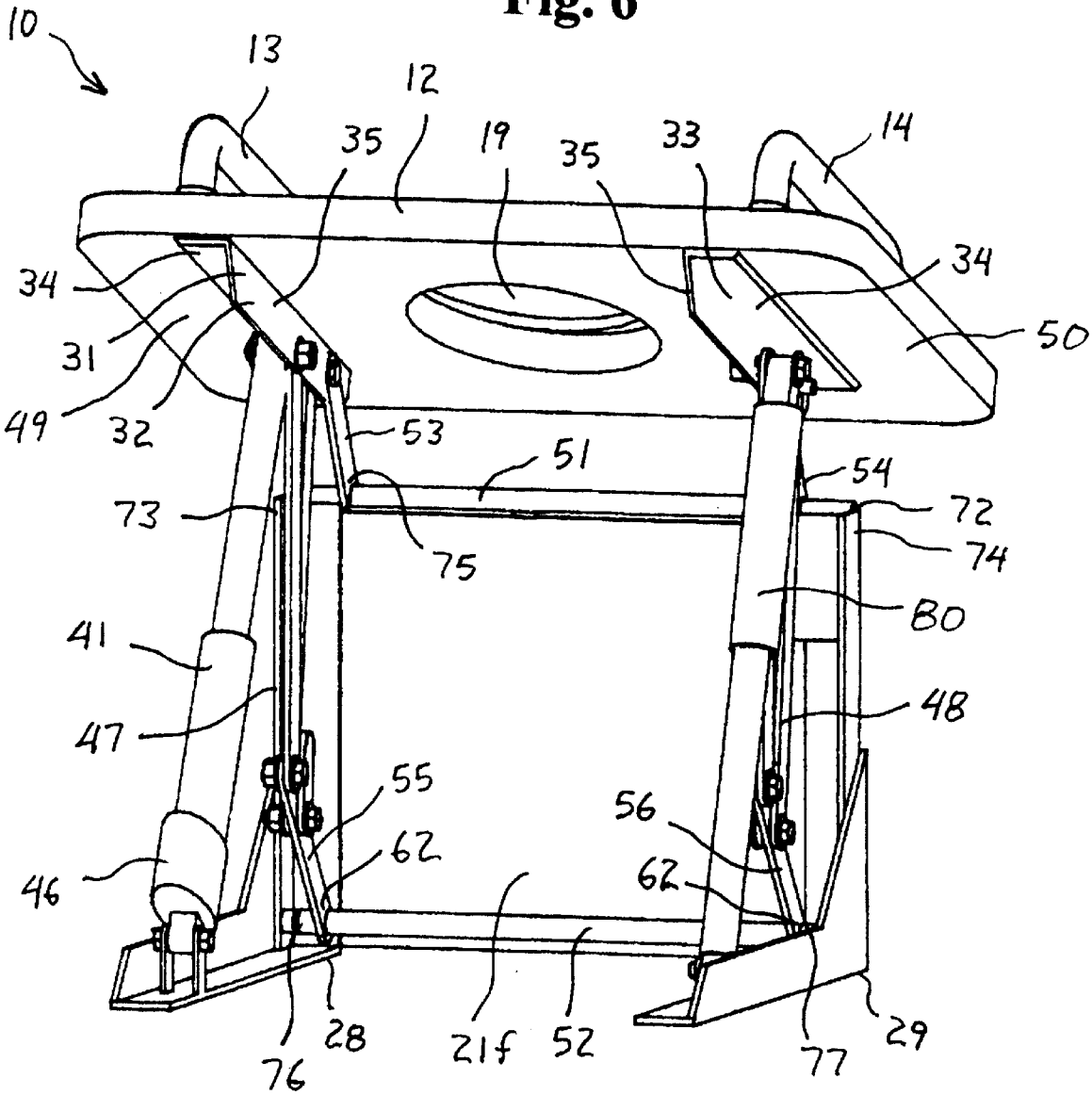
FIG. 6 is a perspective rear view of the power-assisted toilet seat lift assembly in a raised position according to the present invention.

FIGS. 4, 5 and 6 show front and rear perspective views of the toilet seat lift assembly 10 in its fully raised position. These views are provided to facilitate a complete understanding of the various components described above and the operation of the toilet seat lift assembly 10 of the present invention.

Figure 7:
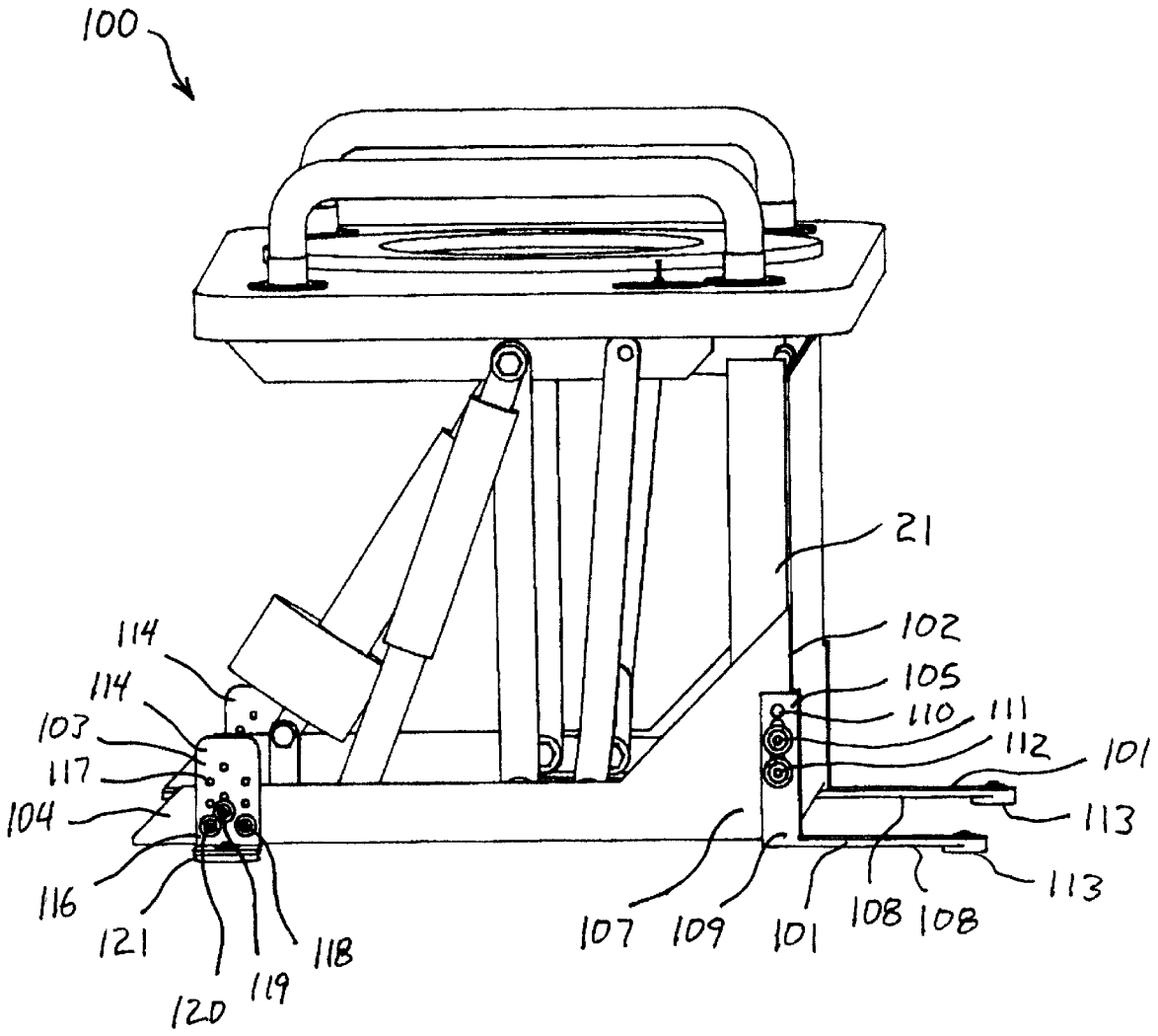
FIG. 7 is a perspective side view of the power-assisted toilet seat lift assembly equipped with height adjustable feet according to the present invention.
Figure 8:
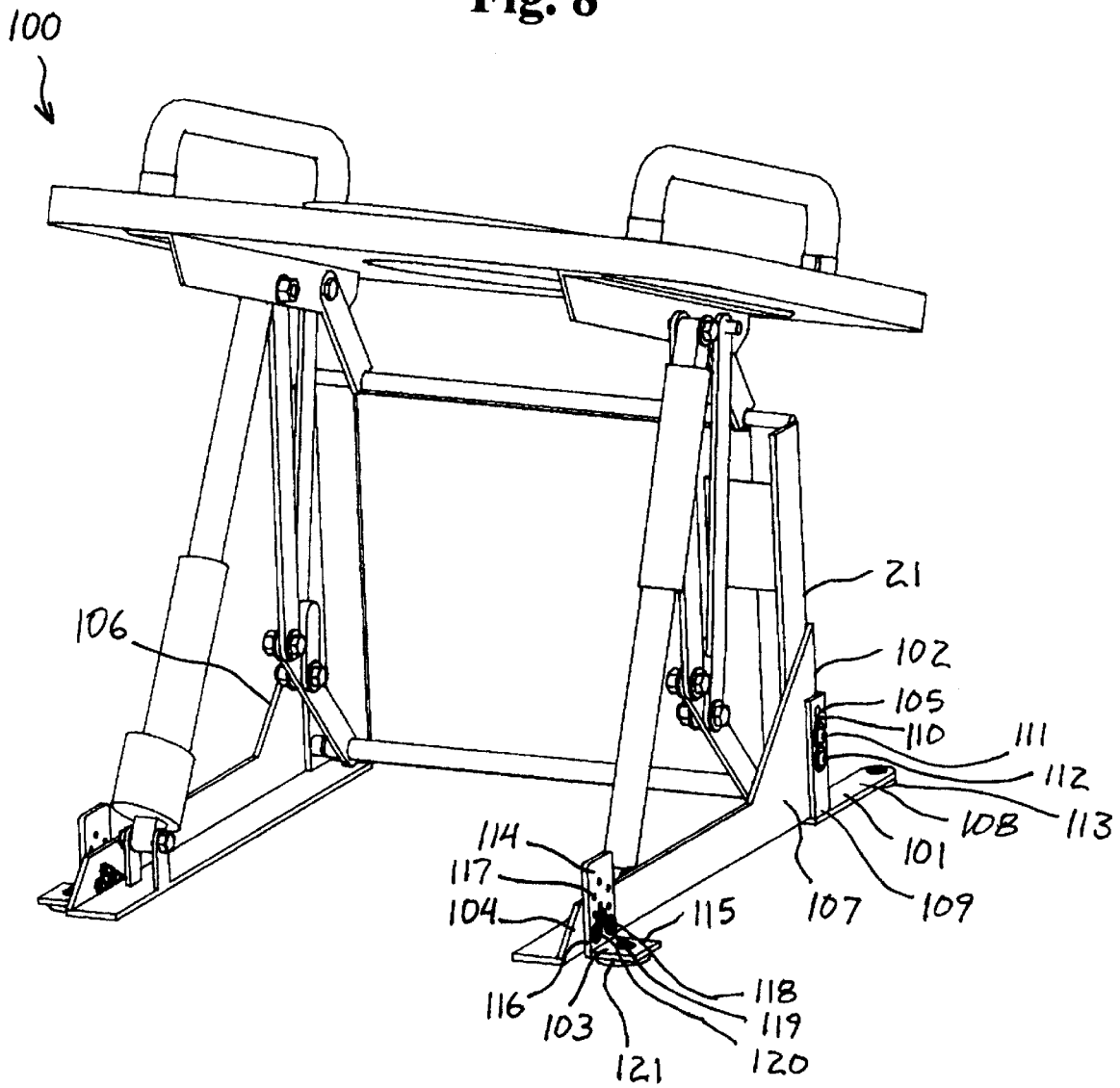
FIG. 8 is a perspective rear view of the power-assisted toilet seat lift assembly equipped with height adjustable feed according to the present invention.

FIGS. 7 and 8 are perspective side and rear views of an alternative embodiment of the toilet seat lift assembly 100 of the present invention. The alternative embodiment shown in these figures has the same structure as the toilet seat lift assembly 10 described above and shown in FIGS. 1 to 6, except that the toilet seat lift assembly 100 of the alternative embodiment also includes adjustable feet to adjust the height of the lower frame 21. The adjustable feet include a pair of front feet 101 secured to the front end 102 of the lower frame 21, and a pair of rear feet 103 secured to the rear end 104 of the lower frame 21.

The front feet 101 have upstanding portions 105 attached to the respective sides 106, 107 of the front end 102 of the lower frame 21, and forwardly protruding portions 108 extending from the lower ends 109 of the upstanding portions 105. The upstanding portions 105 have a plurality of vertically spaced bores 110 through which threaded fasteners 111, 112 extend to attach the front feet 101 to the lower frame 21. The lower frame 21 is provided with corresponding bores to receive the threaded fasteners 111, 112. The front feet 101 are vertically adjustable relative to the lower frame 21 by removing the threaded fasteners 111, 112 and moving the front feet 101 relative to the lower frame 21 until a different set of bores 110 in the upstanding portions 105 of the front feet 101 are aligned with the bores in the lower frame 21. The threaded fasteners 111, 112 are then reinserted through the respective bores and tightened to secure the front feet 101 to the lower frame 21 at the selected vertical position. The forwardly protruding portions 108 of the front feet 101 have pads 113 on the lower sides of the front tips thereof for engaging a floor on which the seat lift assembly 100 is placed. The pads 113 are preferably secured to the front feet 101 using threaded studs that are received adjustably in corresponding threaded bores in the front feet 101. The pads 113 on the front feet 101 function to engage the floor and stabilize the seat lift assembly 100 during use to prevent the seat lift assembly 100 from tipping forwardly. An alternative way to stabilize the seat lift assembly 100 is to secure the rear ends 104 of the lower frame 21 to the floor using, for example, threaded screws or the like.

The rear feet 103 have upstanding portions 114 and outwardly protruding portions 115 that extend outwardly from the lower ends 116 of the upstanding portions 114. The upstanding portions 114 of the rear feet 103 have a plurality of vertically spaced bores 117 and are attached to the rear ends 104 of the lower frame 21 by threaded fasteners 118, 119, 120 extending through corresponding bores in the lower frame 21. The rear feet 103 are vertically adjustable relative to the lower frame 21 by removing the threaded fasteners 118, 119, 120 and moving the rear feet 103 relative to the lower frame 21 until a different set of bores 117 in the rear feet 103 are aligned with the bores in the lower frame 21. The threaded fasteners 118, 119, 120 are then reinserted through the respective bores and tightened to secure the rear feet 103 to the lower frame 21 at the selected vertical position. The outwardly protruding portions 115 of the rear feet 103 have pads 121 on their lower sides for engaging a floor on which the seat lift assembly 100 is placed. The pads 121 are preferably secured to the rear feet 103 using threaded studs that are received adjustably in corresponding threaded bores in the rear feet 103. The adjustable front and rear feet 101, 103 allow the toilet seat lift assembly 100 to be adjusted to an optimum height and maintained in a stable condition during use.

The toilet seat lift assembly 10, 100 of the present invention provides an improved device for assisting physically impaired persons in performing normal toilet functions. The heavy duty construction and arrangement of linkages allow stable, smooth and efficient lifting of heavy persons. The lift assembly 10, 100 utilizes existing toilet facilities, fitting over a conventional toilet bowl, and therefore does not require a health care provider to empty any portable pots or the like. Considerable ease of mind is possible with the present invention by allowing physically impaired persons to enjoy private toilet functions and eliminating worries about being dropped or mishandled by a health care provider, for example, when the lifting load is different from the provider expected.

It will be appreciated that the present invention is not limited to the exact constructions that have been described above and illustrated in the accompanying drawings, and that various modifications and changes can be made without departing from the scope and spirit of the invention. It is intended that the scope of the invention be limited only by the appended claims.

What is claimed is:

1. A power-assisted toilet seat lift assembly, comprising:

a toilet seat;

a support assembly adapted to support said toilet seat over a conventional toilet in a position suitable for use by a user, said support assembly having a lower frame and an upper frame connected together by a lift mechanism;

said lower frame having a first portion adapted to rest on a floor adjacent to the toilet and a second portion that extends upwardly from a front end of said first portion;

said upper frame having a top side on which said toilet seat is secured, and a bottom side on which said lift mechanism is secured; and said lift mechanism comprising a driving member and a first linkage assembly connected between said lower frame and said upper frame, said first linkage assembly comprising a first link pivotally connected between an upper end of the second portion of said lower frame and a front end of said upper frame, a second link having a first end pivotally connected to a lower front end of the lower frame, a third link having a first end pivotally connected to said upper frame at a location spaced rearward from said front end of said upper frame, said second and third links each having second ends that are pivotally connected together, and a fourth link having a first end pivotally connected to said second link at a location spaced from said second end of said second link, said fourth link having a second end pivotally connected to said upper frame at a location spaced from said first end of said third link, said driving member being operable in conjunction with said first linkage assembly to move said upper frame relative to said lower frame, whereby said toilet seat can be moved from a lowered position to a raised position in which the toilet seat is lifted upwardly, displaced forwardly, and tilted with a rear end of the toilet seat higher than a front end of the toilet seat to accommodate a physically impaired person.

2. The power-assisted toilet seat lift assembly according to claim 1, wherein said fourth link is pivotally connected to said second link at a connection point located between said first and second ends of said second link.

3. The power-assisted toilet seat lift assembly according to claim 2, wherein said fourth link is pivotally connected to said upper frame at a same location as said first link is connected to said upper frame.

4. The power-assisted toilet seat lift assembly according to claim 1, wherein said driving member comprises a linear actuator.

5. The power-assisted toilet seat lift assembly according to claim 4, wherein said linear actuator has a first end connected to a rear end of said lower frame and a second end connected to said upper frame at a same location as said third link is connected to said upper frame.

6. The power-assisted toilet seat lift assembly according to claim 4, wherein said linear actuator comprises an electric motor operable to change a length of said actuator to cause said upper frame to be moved relative to said lower frame, and further comprising a switch that can be operated by a physically impaired person to selectively energize said electric motor.

7. The power-assisted toilet seat lift assembly according to claim 1, wherein said lower frame comprises first and second sides adapted to be placed on respective sides of a conventional toilet and a front portion connecting said first and second sides, said upper frame comprises first and second sides that correspond with the first and second sides of said lower frame, said first linkage assembly is connected between the respective first sides of the upper and lower frame, and said lift mechanism further comprises a second linkage assembly having first, second, third and fourth links that are connected in substantially the same configuration as the respective links of said first linkage assembly, said second linkage assembly being connected between the respective second sides of the upper and lower frame.

8. The power-assisted toilet seat lift assembly according to claim 7, wherein said second linkage assembly is connected to said first linkage assembly by a first transverse shaft extending between and connected to the respective first links, and a second transverse shaft extending between and connected to the respective second links, whereby said first and second transverse shafts function to transfer loads between said first and second linkage assemblies to increase the load capacity and stability of the seat lift assembly.

9. The power-assisted toilet seat lift assembly according to claim 8, wherein said first transverse shaft is fixed to said first links and extends generally along a first pivot axis about which said first links are connected to said lower frame, and said second transverse shaft is fixed to said second links and extends generally along a second pivot axis about which said second links are connected to said lower frame.

10. The power-assisted toilet seat lift assembly according to claim 7, further comprising a shock absorber mechanism having a first end connected to said lower frame and a second end connected to said upper frame, whereby said shock absorber mechanism ensures a slow descent of the toilet seat in the event of a mechanical failure of said drive member.

11. The power-assisted toilet seat lift assembly according to claim 1, wherein said upper frame comprises a platform having a central opening and first and second handles secured on respective sides of said central opening, and said toilet seat is secured to said platform between said first and second handles and positioned over said central opening, said central opening being adapted to be aligned with an opening in a conventional toilet when said seat lift assembly is positioned thereover.

12. The power-assisted toilet seat lift assembly according to claim 1, further comprising a plurality of vertically adjustable feet connected to said lower frame for adjusting a vertical height of said seat lift assembly.

13. The power-assisted toilet seat lift assembly according to claim 1, wherein a connection point of said fourth link to said second link is changeable to adjust an amount of tilt of said toilet seat upon movement of said upper frame to a raised position.

14. A power-assisted toilet seat lift assembly, comprising:

a support assembly having a movable platform adapted to support a toilet seat over a conventional toilet;

a drive member connected to said support assembly for moving said platform; and a linkage means pivotally connected to a plurality of pivot points on respective sides of a central opening of said platform for stabilizing and controlling a movement of said platform upon actuation of said drive member, said linkage means having an arrangement of link members that cause said movable platform to pivot and move forwardly when said platform is raised by actuation of said drive member;

wherein said support assembly comprises a lower frame adapted to rest on a floor adjacent to a conventional toilet and an upper frame secured to said movable platform, and said linkage means comprises a first linkage assembly having a first link pivotally connected between said lower frame and a front end of said upper frame, a second link having a first end pivotally connected to the lower frame below where said first link is pivotally connected to the lower frame, a third link having a first end pivotally connected to said upper frame at a location spaced rearward from said front end of said upper frame, said second and third links each having second ends that are pivotally connected together, and a fourth link having a first end pivotally connected to said second link at a location spaced from said second end of said second link, said fourth link having a second end pivotally connected to said upper frame at a location spaced from said first end of said third link.

15. The power-assisted toilet seat lift assembly according to claim 14, wherein said lower frame having first and second sides adapted to be placed on respective sides of a conventional toilet and a front portion connecting said first and second sides, said upper frame having first and second sides that correspond with the first and second sides of said lower frame, said first linkage assembly connected between the respective first sides of the upper and lower frame, and a second linkage assembly connected between the respective second sides of the upper and lower frame, said second linkage assembly is connected to said first linkage assembly by at least one torsion shaft for transferring loads between said first and second linkage assemblies to increase a load capacity and stability of the seat lift assembly.

16. The power-assisted toilet seat lift assembly according to claim 14, wherein said lower frame has a first portion adapted to rest on a floor adjacent to a conventional toilet and a second portion that extends upwardly from a front end of said first portion, said first link is pivotally connected between an upper end of the second portion of said lower frame and said front end of said upper frame, and said first end of said second link is pivotally connected to a lower end of the second portion of the lower frame.

17. The power-assisted toilet seat lift assembly according to claim 16, wherein said drive member is a linear actuator and has a first end connected to said lower frame and a second end connected to said upper frame.

18. The power-assisted toilet seat lift assembly according to claim 16, wherein said lower frame comprises first and second sides adapted to be placed on respective sides of a conventional toilet and a front portion connecting said first and second sides, said upper frame comprises first and second sides that correspond with the first and second sides of said lower frame, said first linkage assembly is connected between the respective first sides of the upper and lower frame, and said linkage means further comprises a second linkage assembly having first, second, third and fourth links that are connected in substantially the same configuration as the respective links of said first linkage assembly, said second linkage assembly being connected between the respective second sides of the upper and lower frame.

19. The power-assisted toilet seat lift assembly according to claim 18, wherein said second linkage assembly is connected to said first linkage assembly by a first transverse shaft extending between and connected to the respective first links, and a second transverse shaft extending between and connected to the respective second links, whereby said first and second transverse shafts provide means for transferring loads between said first and second linkage assemblies to increase a load capacity and stability of the seat lift assembly.

20. The power-assisted toilet seat lift assembly according to claim 16, further comprising a shock absorber mechanism having a first end connected to said lower frame and a second end connected to said upper frame, whereby said shock absorber mechanism ensures a slow descent of the toilet seat in the event of a mechanical failure of said drive member.

21. The power-assisted toilet seat lift assembly according to claim 14, wherein said platform has a central opening and first and second handles secured on respective sides of said central opening, said central opening being adapted to be aligned with an opening in a conventional toilet when said seat lift assembly is positioned thereover.

* * * * *